US009544971B2

(12) United States Patent
Pamato et al.

(10) Patent No.: US 9,544,971 B2
(45) Date of Patent: Jan. 10, 2017

(54) SINGLE LED SHORT DETECTION IN MULTICHANNEL LED

(71) Applicant: Infineon Technologies AG, Neubiberg (DE)

(72) Inventors: Marco Pamato, Schio (IT); Damiano Sartori, Padua (IT); Maurizio Galvano, Padua (IT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 14/530,453

(22) Filed: Oct. 31, 2014

(65) Prior Publication Data

US 2016/0128139 A1 May 5, 2016

(51) Int. Cl.
*H05B 37/02* (2006.01)
*H05B 33/08* (2006.01)

(52) U.S. Cl.
CPC ..... *H05B 33/089* (2013.01); *H05B 33/0827* (2013.01)

(58) Field of Classification Search
USPC ..... 315/185 R, 291, 312, 324
See application file for complete search history.

(56) References Cited

U.S. PATENT DOCUMENTS

| | | | | |
|---|---|---|---|---|
| 7,595,596 | B2 * | 9/2009 | Liu | H05B 33/0896 315/209 R |
| 8,081,199 | B2 * | 12/2011 | Takata | G09G 3/342 345/102 |
| 8,269,430 | B2 * | 9/2012 | Nakai | H05B 33/0815 315/185 R |
| 8,384,305 | B2 * | 2/2013 | Liao | H02M 3/33507 315/294 |
| 2010/0264828 | A1 | 10/2010 | Cortigiani et al. | |
| 2012/0074947 | A1 | 3/2012 | Cortigiani et al. | |
| 2013/0314127 | A1 * | 11/2013 | Oyama | G05F 3/242 327/88 |

* cited by examiner

*Primary Examiner* — Thuy Vinh Tran
(74) *Attorney, Agent, or Firm* — Shumaker & Sieffert, P.A.

(57) ABSTRACT

A method and circuit are described in which a maximum voltage is determined from among a plurality of series load voltages, where each series load voltage of the plurality of series load voltages is a voltage defined by a corresponding series of N loads of a plurality of series of N loads, where N is an integer greater than one. Also, a minimum voltage may be determined from among the plurality of series load voltages. Next, the maximum voltage from among the plurality of series load voltages may be compared with the minimum voltage from among the plurality of series load voltages to make a determination as to whether the maximum voltage from among the plurality of series load voltages exceeds the minimum from among the plurality of series load voltages by a threshold voltage. Then, an indication can be output based on the results of the determination.

19 Claims, 6 Drawing Sheets

SINGLE LED SHORT DETECTION IN MULTICHANNEL LED

TECHNICAL FIELD

This disclosure relates to electronic circuits, and more specifically to failure detection in chains of electronic loads, such as in light emitting diodes (LEDs).

BACKGROUND

Illumination devices (e.g., lamps) that comprise light emitting diodes (LEDs) as luminescent components usually cannot simply be connected to a voltage supply but have to be driven by special driver circuits (or control circuits) providing a defined load current to the LEDs in order to provide a desired radiant power (radiant flux). Since a single LED exhibits only small forward voltages (from about 1.5 V for infrared GaAs LEDs ranging up to 4 V for violet and ultraviolet InGaN LEDs) compared to commonly used supply voltages (for example, 12 V, 24 V and 42 V in automotive applications) several LEDs are connected in series to form so-called LED chains.

In many applications, it is desirable to have a fault detection included in the driver circuits (or control circuits) that allows for detecting defective LEDS in the LED chains connected to the driver circuit. An LED can be regarded as a two-terminal network. A defective LED can manifest in either an open circuit or a short circuit between the two terminals. If one LED of a LED chain fails as an open circuit this is relatively easy to detect since the defective LED interrupts the current for the whole LED chain. If one LED of a LED chain fails as a short circuit, however, only the defective LED stops radiating, which may be more difficult to detect.

SUMMARY

In general, the disclosure is directed to a method and circuit in which a maximum voltage is determined from among a plurality of series load voltages, where each series load voltage of the plurality of series load voltages is a voltage defined by a corresponding series of N loads of a plurality of series of N loads, where N is an integer greater than one. Also, a minimum voltage is determined from among the plurality of series load voltages. Next, the maximum voltage from among the plurality of series load voltages is compared with the minimum voltage from among the plurality of series load voltages to make a determination as to whether the maximum voltage from among the plurality of series load voltages exceeds the minimum from among the plurality of series load voltages by a threshold voltage. Then, an indication is output based on the results of the determination.

In some examples, a method comprises: determining a maximum voltage from among a plurality of series load voltages, wherein each series load voltage of the plurality of series load voltages is a voltage defined by a corresponding series of N loads of a plurality of series of N loads, wherein N is an integer greater than one; determining a minimum voltage from among the plurality of series load voltages; comparing the maximum voltage from among the plurality of series voltages with the minimum voltage from among the plurality of series load voltages to make a determination as to whether the maximum voltage from among the plurality of series load voltages exceeds the minimum from among the plurality of series voltages by a threshold voltage; and outputting an indication based on a result of the determination.

In some examples, a circuit, comprises: a maximum selector circuit having a plurality of inputs and an output, wherein the maximum selector circuit is arranged to receive each series load voltage of a plurality of series load voltages at a corresponding input of the plurality of inputs, and to provide a maximum voltage from among the plurality of series load voltages at the output of the maximum selector circuit, wherein each series load voltage of the plurality of series load voltages is a voltage defined by a corresponding series of N loads of a plurality of series of N loads, wherein N is an integer greater than one; a minimum selector circuit having a plurality of inputs and an output, wherein the minimum selector circuit is arranged to receive each series load voltage of the plurality of series load voltages at a corresponding input of the plurality of inputs of the minimum selector circuit, and to provide a minimum voltage from among the plurality of series load voltages at the output of the minimum selector circuit; and a comparison circuit having an output, a first input that is coupled to the output of the maximum selector circuit, and a second input that is coupled to the output of the minimum selector circuit, wherein the comparison circuit is arranged to compare the maximum voltage from among the plurality of series load voltages with the minimum voltage from among the plurality of series load voltages to make a determination as to whether the maximum voltage from among the plurality of series load voltages exceeds the minimum from among the plurality of series load voltages by a threshold voltage; and to output, at the output of the comparison circuit, an indication based on a result of the determination.

The details of one or more examples of the disclosure are set forth in the accompanying drawings and the description below. Other features, objects, and advantages of the disclosure will be apparent from the description and drawings, and from the claims.

BRIEF DESCRIPTION OF DRAWINGS

Non-limiting and non-exhaustive examples of the present disclosure are described with reference to the following drawings.

DETAILED DESCRIPTION

Figure 1:
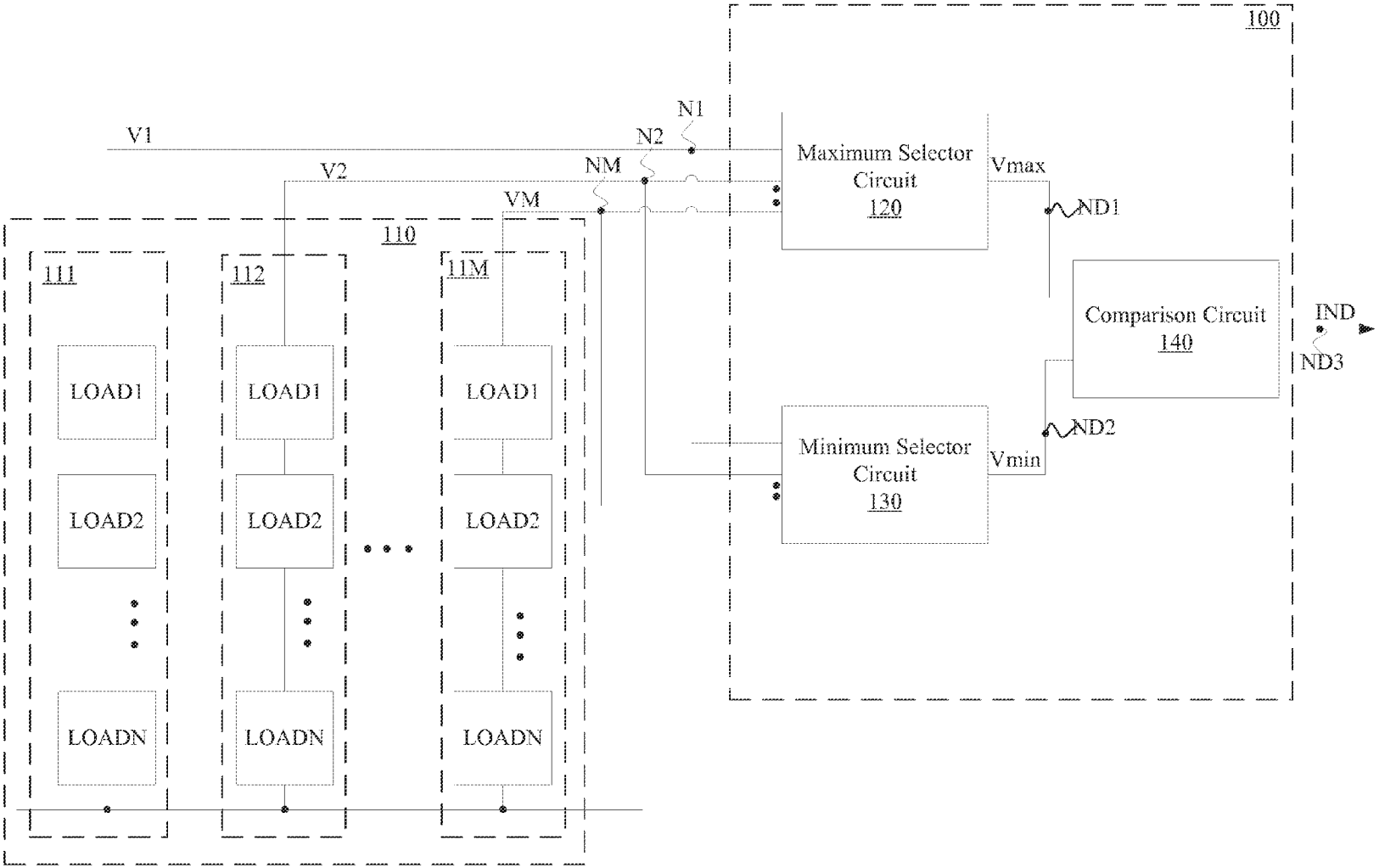
FIG. 1 is a block diagram illustrating an example of a circuit for failure detection for chains of electronic loads.

Various examples of this disclosure will be described in detail with reference to the drawings, where like reference numerals represent like parts and assemblies throughout the several views. Reference to various examples does not limit the scope of this disclosure which is limited only by the scope of the claims attached hereto. Additionally, any examples set forth in this specification are not intended to be limiting and merely set forth some of the many possible examples of this disclosure.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference, and the meaning of "in" includes "in" and "on." The phrase "in one embodiment," or "in one example," as used herein does not necessarily refer to the same embodiment or example, although it may be the case. Similarly, the phrase "in some embodiments," or "in some examples," as used herein, when used multiple times, does not necessarily refer to the same embodiments or examples, although it may. As used herein, the term "or" is an inclusive "or" operator, and is equivalent to the term "and/or," unless the context clearly dictates otherwise. The term "based, in part, on", "based, at least in part, on", or "based on" is not exclusive and allows for being based on additional factors not described, unless the context clearly dictates otherwise. Where suitable, the term "gate" is intended to be a generic term covering both "gate" and "base"; the term "source" is intended to be a generic term covering both "source" and "emitter"; and the term "drain" is intended to be a generic term covering both "drain" and "collector." The term "coupled" means at least either a direct electrical connection between the items connected, or an indirect connection through one or more passive or active intermediary devices. The term "signal" means at least one current, voltage, charge, temperature, data, or other signal.

FIG. 1 is a block diagram illustrating an example of a circuit (100) for failure detection for chains of electronic loads 110. Circuit 100 includes maximum selector circuit 120, minimum selector circuit 130, and comparison circuit 140. Chains of electronic loads 110 include series of loads 111 through series of loads 11M, where M is an integer greater than 1. Each series of loads contains loads LOAD1 through LOADN, where N is an integer greater than 1. Each series of loads 111 through 11M contains the same number of loads as each other series of loads 111 through 11M. In each series of loads 111 through 11M, each of the loads LOAD1 through LOADN is coupled in series. Each series of loads 111 through 11M is coupled to a corresponding node N1 through NM and arranged to provide a series load voltage V1 through VM at the corresponding node N1 through NM.

Each load LOAD1-LOADN is arranged to have substantially the same voltage drop as each of the other loads LOAD1-LOADN in each of the series of loads 111 through 11M, when under substantially the same operations conditions, and when not in a failure condition. Accordingly, when each of the loads is under the substantially the same operating conditions, each of the series of load 111 through 11M provides a series load voltage V1 through VM at nodes N1 through NM such that each of the voltage V1 through VM are substantially equal to each other. Although each load LOAD1-LOADN is arranged to have substantially the same voltage drop as each of the other loads LOAD1-LOADN in each of the series of loads 111 through 11M, there may be some variation in the voltage drop from part to part.

In the example of FIG. 1, maximum selector circuit 120 has M inputs, where each input is coupled to a corresponding node N1 through NM. Minimum selector 130 circuit has M inputs, where each input is coupled to a corresponding node N1 through NM. Maximum selector circuit 120 also has an output coupled to node ND1. Similarly, minimum selector circuit 130 also has an output coupled to node ND2. Comparison circuit 140 has a first input coupled to node ND1, a second input coupled to node ND2, and an output coupled to node ND3.

Maximum selector circuit 120 is arranged to receive each voltages V1 through VM at a corresponding input at nodes N1 through NM. Maximum selector circuit 120 is further arranged to provide voltage Vmax at the output of maximum selector circuit 120 at node ND1 such that voltage Vmax is a maximum voltage from among voltages V1 through VM.

Minimum selector circuit 130 is arranged to receive each voltages V1 through VM at a corresponding input at nodes N1 through NM. Minimum selector circuit 130 is further arranged to provide voltage Vmin at the output of minimum selector circuit 130 at node ND2 such that voltage Vmin is a minimum voltage from among voltages V1 through VM at the output of minimum selector circuit 130 at node ND2.

Comparison circuit 140 is arranged to receive voltage Vmax at the first input of comparison circuit 140 at node ND1, to receive voltage Vmin at the second input of comparison circuit 140 at node ND2, and to output an indication signal IND at the output of comparison circuit 140 at node ND3. Comparison circuit 140 is arranged to compare the Vmax with Vmin to make a determination as to whether the Vmax exceeds Vmin by a threshold (e.g., threshold voltage Vthresh), and to output, via signal IND, an indication based on a result of the determination.

In some examples, threshold voltage Vthresh is equal to an expected voltage drop across one of the loads LOAD1 through LOADN of one of the series of loads 111 through 11M, divided by two. In some examples in which one of the loads LOAD1 through LOADN of each of the series of loads 111 through 11M is an LED, Vthresh=VLED/2. However, the disclosure is not so limited, and other suitable values may be used for threshold voltage Vthresh in other examples of the disclosure.

In some examples, threshold voltage Vthresh is a constant, fixed value. In other examples, threshold voltage Vthresh may be set and/or adjusted by a user, for example by providing a digital, analog, or other signal that is used to set and/or adjust threshold voltage Vthresh, by providing an external part in which some value of the external part sets and/or adjusts threshold voltage Vthresh, and/or the like. In some examples in which threshold voltage threshold voltage Vthresh may be set and/or adjusted by the user, one or more external pins (not shown) may be provided on circuit 100 or on a module that includes circuit 100 for this purpose.

Threshold voltage Vthresh is set to a suitable value so that, under worst case conditions, failure conditions may be properly detected, and under worst case conditions, failure conditions are not falsely detected. These conditions may include, inter alia, variations in the loads, where different loads might have different voltage drops than the expected value for the voltage drop of each load due to, e.g., manufacturing variations.

Each of the loads LOAD1 through LOADN of each of the series of loads 111 through 11M receives substantially the same current. Each of the loads LOAD1 through LOADN of each of the series of loads 111 through 11M responds similarly to changes in operating conditions. For example, each of the loads LOAD1 through LOADN of each of the series of loads 111 through 11M responds in a substantially similar manner to changes in temperature.

The failure detection performed by circuit 100 may be substantially temperature independent because each of the loads LOAD1 through LOADN of each of the series of loads 111 through 11M responds in a substantially similar manner to variations in temperature.

In some examples, each of the loads LOAD1 through LOADN of each of the series of loads 111 through 11M is a solid-state LED. In these examples, each of the series of loads 111 through 11M is a chain of series-coupled solid-state LEDs. Each chain of series-coupled solid-state LEDs receives substantially the same current. In some examples, each chain of series-coupled LEDs received a regulated current from an LED driver circuit, where each chain of series-coupled solid-state LEDs receives substantially the same regulated current from the LED driver circuit. Each of the loads LOAD1 through LOADN of each of the series of loads 111 through 11M has a voltage drop of VLED. Also, in these examples, each solid-state LED in each of the chains of series-coupled solid-state LEDs are all on the same module as each other.

The examples in which each of the loads LOAD1 through LOADN of each of the series of loads 111 through 11M is a solid-state LED has numerous applications. In some example, the chains of series-coupled solid-state LEDs may be used in automotive applications. One example automotive application is headlights. In other examples, there are many other applications for the chains of series-coupled solid-state LEDs, including various illumination applications.

In some examples, each of the loads LOAD1 through LOADN of each of the series of loads 111 through 11M is a type of LED other than a solid-state LED, such as an organic LED (OLED). In these examples, each of the series of loads 111 through 11M is a chain of series-coupled LEDs. Each chain of series-coupled LEDs receives substantially the same current. In some example, each chain of series-coupled LEDs receives a regulated current from an LED driver circuit, where each chain of series-coupled LEDs receives substantially the same regulated current from the LED driver circuit. Each of the loads LOAD1 through LOADN of each of the series of loads 111 through 11M has a voltage drop of VLED. Also, in these examples, each LED in each of the chains of series-coupled LEDs are all on the same module as each other.

In some examples, each of the loads LOAD1 through LOADN of each of the series of loads 111 through 11M is a Zener diode. In these examples, each of the series of loads 111 through 11M is a chain of series-coupled Zener diodes. Each chain of series-coupled Zener diodes receives substantially the same current. Each of the loads LOAD1 through LOADN of each of the series of loads 111 through 11M has a voltage drop corresponding to the forward voltage drop across the Zener diode.

In some examples, each of the loads LOAD1 through LOADN of each of the series of loads 111 through 11M is a diode. In these examples, each of the series of loads 111 through 11M is a chain of series-coupled diodes. Each chain of series-coupled diodes receives substantially the same current. Each of the loads LOAD1 through LOADN of each of the series of loads 111 through 11M has a voltage drop corresponding to the forward voltage drop across the diode.

In some examples, each of the loads LOAD1 through LOADN of each of the series of loads 111 through 11M is a circuit element not previously discussed having a forward voltage when properly biased and receiving a current. In these examples, each of the series of loads 111 through 11M is a chain of series-coupled circuit elements. Each chain of series-coupled circuit elements receives substantially the same current. Each of the loads LOAD1 through LOADN of each of the series of loads 111 through 11M has a voltage drop corresponding to the forward voltage drop across the circuit element.

In some examples, each of the loads LOAD1 through LOADN of each of the series of loads 111 through 11M is a resistor. In these examples, each of the series of loads 111 through 11M is a chain of series-coupled resistors. Each chain of series-coupled resistors receives substantially the same current. Each of the loads LOAD1 through LOADN of each of the series of loads 111 through 11M has a voltage drop corresponding to the current through the resistor times the resistor value of the resistor. Each of the resistors in each chain of series-coupled resistors has substantially the same resistor value, and responds similarly to variations in operating conditions such as changes in temperature.

In some examples, each of the loads LOAD1 through LOADN of each of the series of loads 111 through 11M is a resistive load other than a resistor. In these examples, each of the series of loads 111 through 11M is a chain of series-coupled resistive loads. Each chain of series-coupled resistive loads receives substantially the same current. Each of the loads LOAD1 through LOADN of each of the series of loads 111 through 11M has a voltage drop corresponding to the current through the resistive load times the resistance of the resistive load. Each of the resistive loads in each chain of series-coupled resistive loads has substantially the same resistance, and responds similarly to variations in operating conditions such as changes in temperature.

In some examples, signal IND has a first value when Vmax exceed Vmin by more than threshold voltage Vthresh, and signal IND has a second value when Vmax does not exceed Vmin by more than threshold voltage Vthresh. When Vmax exceeds Vmin by more than threshold voltage Vmin, this indicates a failure such as a short circuit condition on of the loads LOAD1 through LOADN on one of the series of loads 111 through 11M. In some examples, circuit 100 provides no indication as to which load has a failure, but only an indication as to whether or not there is a failure in one of loads. Among the failure conditions that circuit 100 is capable of detecting, circuit 100 is capable of detecting a single short. Circuit 100 is capable of detecting failure conditions, including a single short condition, without requiring any extra dedicated pins.

In some examples of circuit 100, threshold voltage Vthresh is provided as part of the function of comparison circuit 140, so that maximum selector circuit 120 provides maximum voltage Vmax from among V1 through VM, minimum selector circuit 130 provides minimum voltage Vmin from among V1 through VM, and comparison circuit 140 provides the threshold voltage Vthresh as a voltage offset, and compares Vmax-Vthresh with Vmin to determine whether Vmax-Vthresh or Vmin is greater. In other examples, maximum selector circuit 120 provides the offset, so that maximum voltage selector 120 outputs Vmax-Vthresh, minimum selector circuit 130 outputs Vmin, and comparison circuit 140 compares the outputs Vmax-Vthresh and Vmin. In this case, the functionality is the same; the difference is merely in which circuit provides the offset of Vthresh. Similarly, in other examples, maximum voltage selector circuit 120 outputs Vmax, minimum voltage selector circuit 130 output Vmin+Vthresh, and comparison circuit 140 compares outputs Vmax and Vmin+Vthresh. These examples and others are within the scope and spirit of the disclosure. However, regardless of whether the offset of threshold voltage Vthresh is provided in maximum voltage circuit 120, minimum voltage circuit 130, or comparison circuit 140, it may still be properly said that maximum selector circuit 120 provides a maximum voltage from among voltages V1 through VM (which may then be subsequently offset by threshold voltage Vthresh in some examples), minimum selector circuit 130 provides a minimum voltage from among voltages V1 through VM (which may then be subsequently offset by threshold voltage Vthresh in some examples), and that comparison circuit 140 compares Vmax with Vmin to make a determination as to whether Vmax exceeds Vmin by a threshold (this is true whether the threshold is provided by maximum selector circuit 120, minimum selector circuit 130, comparison circuit 140, or some other means).

Figure 2:
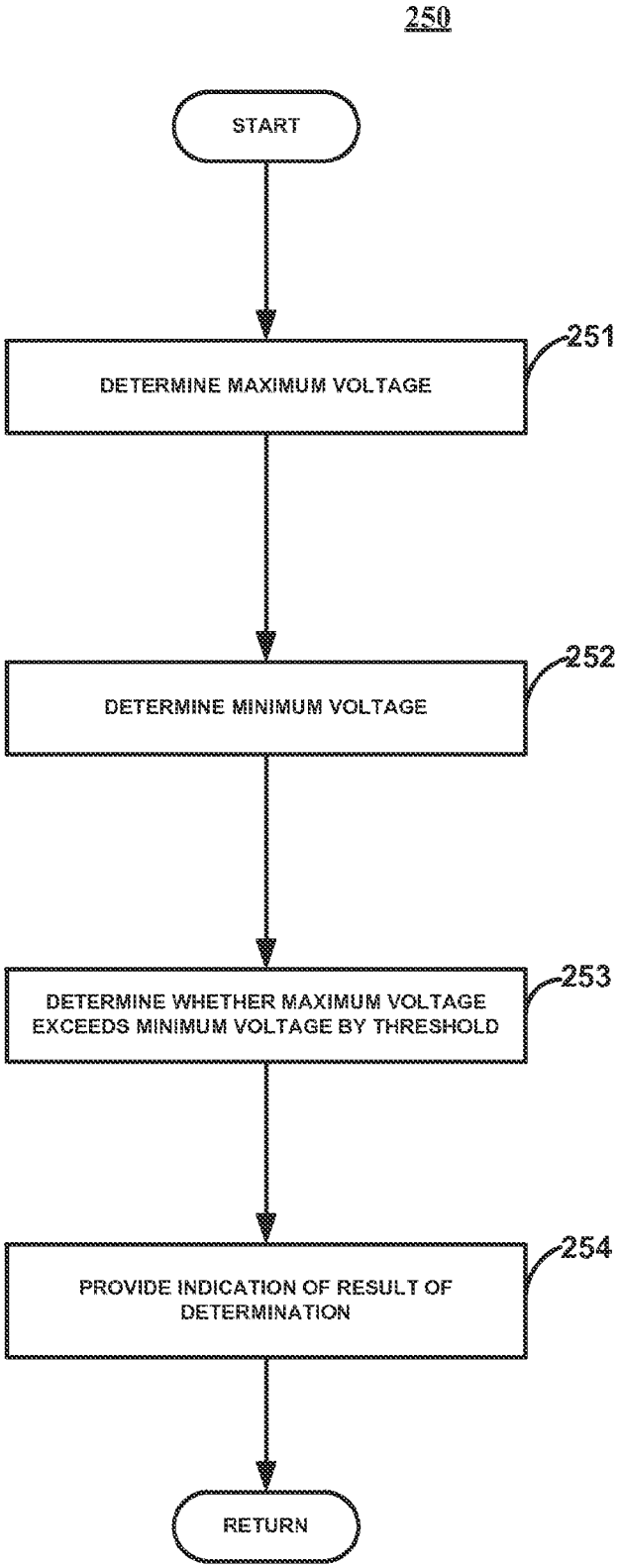
FIG. 2 is a flow diagram illustrating an example of a process for failure detection for chains of electronic loads.

FIG. 2 is a flow diagram illustrating an example of a process (250) for failure detection for chains of electronic loads. The following is one example of process 250 as performed by circuit 100. However, the disclosure is not so limited, and other suitable devices and/or circuits may implement the process of FIG. 2 in other examples within the scope and spirit of the disclosure.

After a start block, maximum selector circuit 120 determines a maximum voltage from among a plurality of series load voltages (251). Each series load voltage of the plurality of series load voltages is a voltage provided by a series of N loads, wherein N is an integer greater than one. Then, minimum selector circuit 130 determines a minimum voltage from among the plurality of series load voltages (252).

Next, comparison circuit 140 compares the maximum voltage from among the plurality of series load voltages with the minimum voltage from among the plurality of series load voltages to make a determination as to whether the maximum voltage from among the plurality of series load voltages exceeds the minimum from among the plurality of series voltages by a threshold (253). Then, comparison circuit 140 outputs an indication based on a result of the determination (254). The process then moves to a return block, where other processing is resumed.

Figure 3:
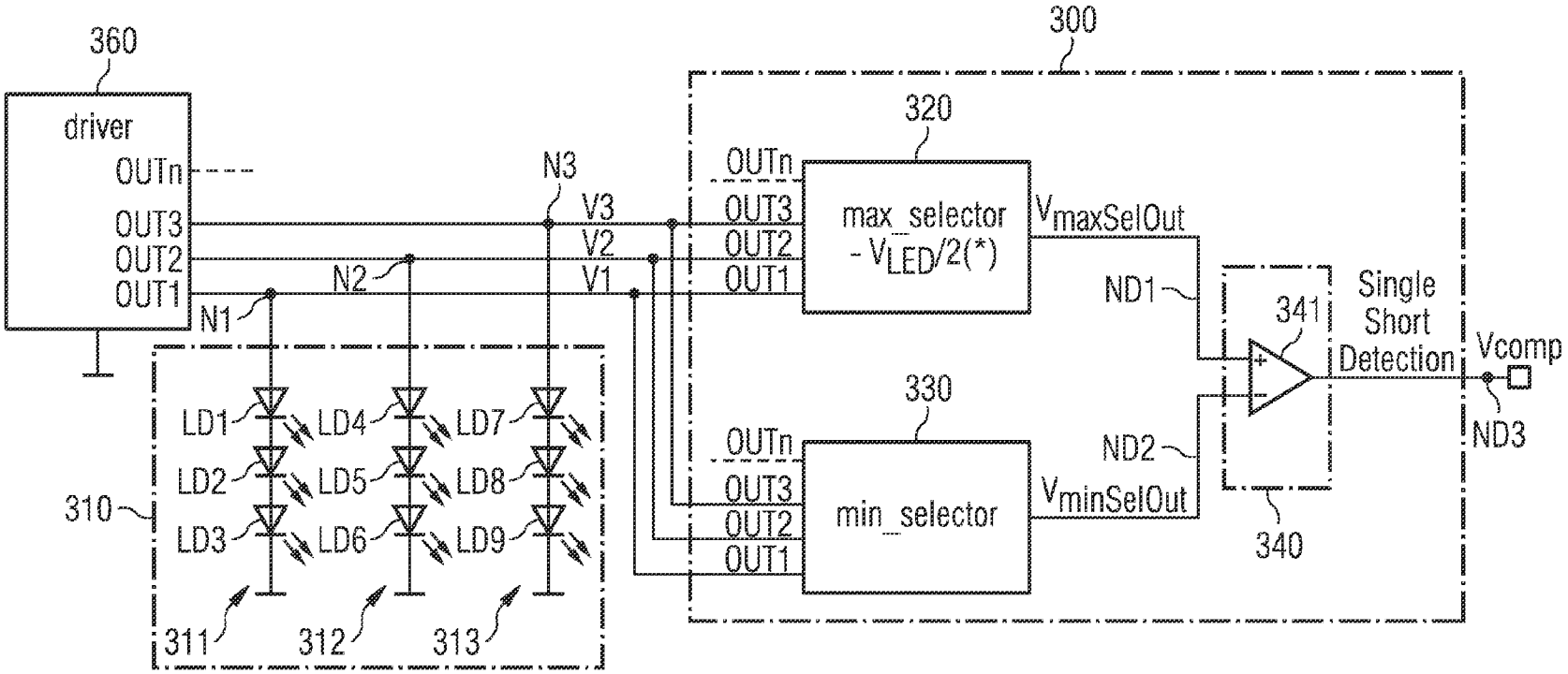
FIG. 3 is a block diagram illustrating an example of the circuit of FIG. 1.

FIG. 3 is a block diagram illustrating an example of circuit 300 and chains of electronic loads 310, which may be employed as examples of circuit 100 and chains of electronic loads 110 of FIG. 1, and further illustrating LED driver circuit 360.

In the specific example illustrated in FIG. 3, the offset of voltage Vthresh, shown as VLED/2 in this example, is present in maximum selector circuit 320 rather than comparison circuit 340. As discussed above with regard to FIG. 1, the offset may be present in, for example, the maximum selector circuit, the minimum selector circuit, or the comparison circuit in various examples.

Comparison circuit 340 includes comparator 341. Chains of electronic loads 310 include series-coupled LED chain 311, series-coupled LED chain 312, and series-coupled LED chain 313. Series-coupled LED chain 311 includes LEDs LD1-LD3, series-coupled LED chain 312 includes LEDs LD4-LD6, and series-coupled LED chain 313 includes LEDs LD7-LD9. LEDs LD1 through LD3 are coupled in series with each other, with LED LD1 coupled to node N1. LEDs LD4 through LD6 are coupled in series with each other, with LED LD4 coupled to node N2. LEDs LD7 through LD9 are coupled in series with each other, with LED LD7 coupled to node N3. Each of the LEDs LD1 through LD9 are all on the same module.

Each of the LEDs LD1 through LD9 is selected to have the same expected forward voltage drop VLED. For example, each of the LEDs LD1 through LD9 may be of the same color and binning class, where LEDs of the same color and binning class have the same expected forward voltage drop VLED. Even though the LEDs have the same expected voltage drop VLED, the actual voltage drop of the different LEDs may vary from part to part. For example, a red LED from binning class 3B may have an expected forward voltage drop of 2.125V, but the actual voltage drop typically varies from 2.05V to 2.20V. The threshold voltage Vthresh is sufficiently large to ensure that a fault is not falsely detected as a result of variation in the actual forward drop of the LEDs from part to part.

FIG. 3 shows a specific example in which there are three series-coupled LED chains, in which each series-coupled LED chain includes three series-coupled LEDs. However, as discussed in greater detail above with respect to FIG. 1, more generically, there are M series-coupled LED chains, in which each series-coupled LED chain includes N series-coupled LEDs, where N and M are both integers greater than one. In the specific example illustrated in FIG. 3, N=3 and M=3, by way of example.

Also, FIG. 3 shows a specific example in which chains of series-coupled loads 310 include chains of series-coupled LEDs. As discussed in greater detail above with regard to claim 1, in various examples, various other types of loads may be employed rather than LEDs. Chains of series-coupled LEDs are one example of chains of series coupled loads 310; other examples may be used within the scope and spirit of the disclosure.

Also, FIG. 3 shows a specific example in which the threshold voltage Vthresh has a fixed value of VLED/2. In other examples, as discussed in greater detail above with regard to FIG. 1, other suitable values for threshold voltage Vthresh may be employed, and in some examples, threshold voltage Vthresh may be set and/or adjusted by the user. These examples and others are within the scope and spirit of the disclosure.

Also, FIG. 3 shows a specific example in which chains of series-coupled LEDs 310 are coupled to ground, so that voltages V1 through V3 are referenced to ground. In other examples, voltages V1 through V3 may be referenced to some voltage other than ground.

Also, although maximum selector circuit 320 and minimum selector circuit 330 are shown as separate circuits, in some example, there may be some circuitry in common between maximum selector circuit 320 and minimum selector circuit 330, so that a portion of maximum selector circuit 320 is a portion of minimum selector circuit 330 in these examples.

Also, although circuit 300 is shown as a separate circuit from LED driver circuit 360, in some examples, circuit 300 is part of LED driver circuit 360 rather than being a separate circuit from LED driver circuit 360.

LED driver circuit 360 is arranged to provide currents Iout1 through Iout3 to each of the respective series-coupled LED chains 311 through 313. LED driver circuit 360 is arranged to provide currents Iout1 through Iout3 are as regulated currents such that currents Iout1 through Iout3 each have substantially the same current value.

Maximum selector circuit 320 is arrange to received voltages V1 through V3, and to provide, at node ND1, voltage Vmaxselout, a voltage equal to the maximum voltage from among voltages V1 through V3, less VLED/2. Minimum selector circuit 330 is arranged to receive voltage V1 through V3, and to provide, and node ND2, voltage Vminselout, a voltage equal to the minimum voltage from among voltages V1 through V3.

Comparison circuit 340 is arranged to compare voltage Vmaxselout with voltage Vminselout, and to provide voltage Vcomp at node ND3 based on the comparison. Voltage Vcomp is an example of signal IND of FIG. 1.

When voltage Vmax-VLED/2 is less than Vmin, comparator 341 provides Vcomp such that Vcomp as unasserted, indicating that no failure is detected. Conversely, when voltage Vmax-VLED/2 is greater than Vmin, comparator 341 asserts Vcomp, indicating that a failure is detected, such as a short condition in one or more of the LEDs LD1 through LD9. Circuit 300 is capable of detecting a single short (among LEDs LD1 through LD9), and when a single short is detected, Vcomp is asserted. The single short is detected as soon as Vmax-VLED/2 is greater than Vmin.

In some examples, voltage Vcomp may act as a status signal that is output via a status pin (not shown), such that comparison circuit 340 provides indication signal IND as a status signal. In various examples, other circuitry may respond in various ways when voltage Vcomp is asserted. In some example, the module that includes loads LD1 through LD9 is turned off when voltage Vcomp is asserted, and all of the LEDs LD1 through LD 9 are accordingly turned off.

Figure 4:
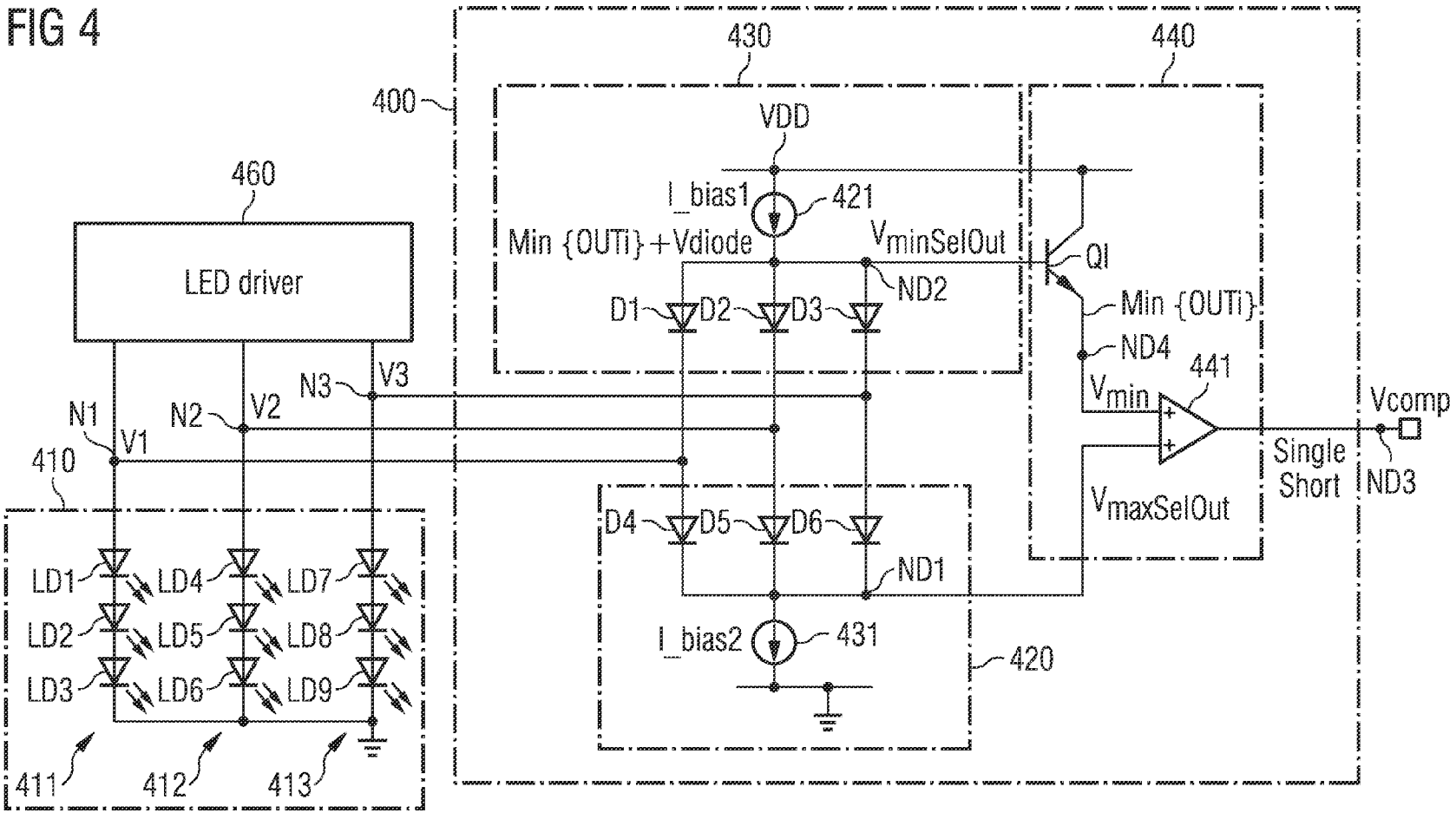
FIG. 4 is a block diagram illustrating an example of the circuit of FIG. 3, in accordance with aspects of the present disclosure.

FIG. 4 is a block diagram illustrating an example of circuit 400, chains of electronic loads 410, and LED driver circuit 460, which may be employed as examples of circuit 300, chains of electronic loads 310, and LED driver circuit 360 of FIG. 3.

Minimum selector circuit 430 includes diodes Dl through D3 and bias current source 421. Maximum selector circuit 420 includes diodes D4 through D6 and bias current 431. Comparison circuit 440 includes comparator 441 and transistor Q1. Transistor Q1 has a base coupled to node ND2, a collector coupled to VDD, and an emitter coupled to node ND4. Comparator 441 has a first input coupled to node ND4, a second input coupled to node ND1, and an output coupled to node ND3. The first input of comparator 441 is coupled to node ND2 via the intermediary element of transistor Q1.

Current source 421 is a current source that is configured to provide bias current I_bias1. Current source 421 is coupled between VDD and node ND2. Current source 431 is a current source that is configured to provide bias current I_bias2. Current source 431 is coupled between node ND2 and Ground. Transistor Q1 is configured to operate as a voltage follower such that the voltage at node ND4 is equal to Vmin+Vdiode−$V_{BEQ1}$, which is substantially equal to Vmin (because Vdiode is substantially equal to $V_{BEQ1}$). Diodes D4-D6 are configured such that Vdiode is equal to Vthresh. In some examples, diodes D4-D6 are configured such that Vdiode is equal to VLED/2.

Although FIG. 4 illustrates a particular example of maximum selector 420 and minimum selector 430, the disclosure is not so limited. Any suitable means, analog, digital, or analog and digital, suitable for selecting the maximum voltage from among V1 and V3 may be employed for maximum selector circuit 420. Similarly, any suitable means, analog, digital, or analog and digital, suitable for selecting the maximum voltage from among V1 and V3 may be employed for minimum selector 430. In some examples, maximum selector 420 and/or minimum selector 430 may be a number of comparators in conjunction with logic and a multiplexer to determine and output the maximum or minimum from among V1 through V3.

In other examples, maximum selector circuit 420 and/or minimum selector circuit 430 may include a multi-input comparator and a multiplexer. In some examples, maximum selector circuit 420 and/or minimum selector circuit 430 may convert voltages V1 and V3 into digital values with an analog-to-digital converter, use digital logic or the like determine which value is the maximum and/or the minimum, output the result as a digital value, and then use an digital-to-analog converter to convert the output digital value into a voltage, or in other examples instead use the output digital value to control a multiplexer to select the determined maximum or minimum from among V1 through V3 at the output of maximum selector 420 and/or minimum selector 430.

As discussed above, in some examples, part or all of the circuitry of maximum selector circuit 420 and minimum selector circuit 430 may be combined. In some examples, rather than employing separate circuits for maximum selector circuit 420 and minimum selector circuit 430, circuit 400 may employ a single maximum/minimum selector circuit that outputs both a maximum voltage Vmax as the maximum from among voltage V1 through V3 as Vmax and a minimum voltage from among V1 through V3 as Vmin. However, in these examples, the combined circuit may still be regarded a maximum selector circuit and a minimum selector circuit, with those portions of the circuitry that determine and output the maximum voltage from among V1 and V3 regarded as the maximum selector circuit and those portions of the circuitry that determine and output the minimum voltage from among V1 through V3 as the minimum selector circuit; even if the maximum selector circuit and the minimum selector circuit share some circuitry, they can still be regarded as a maximum selector circuit and a minimum selector circuit.

Figures 5A, 5B, 5C, 5D:
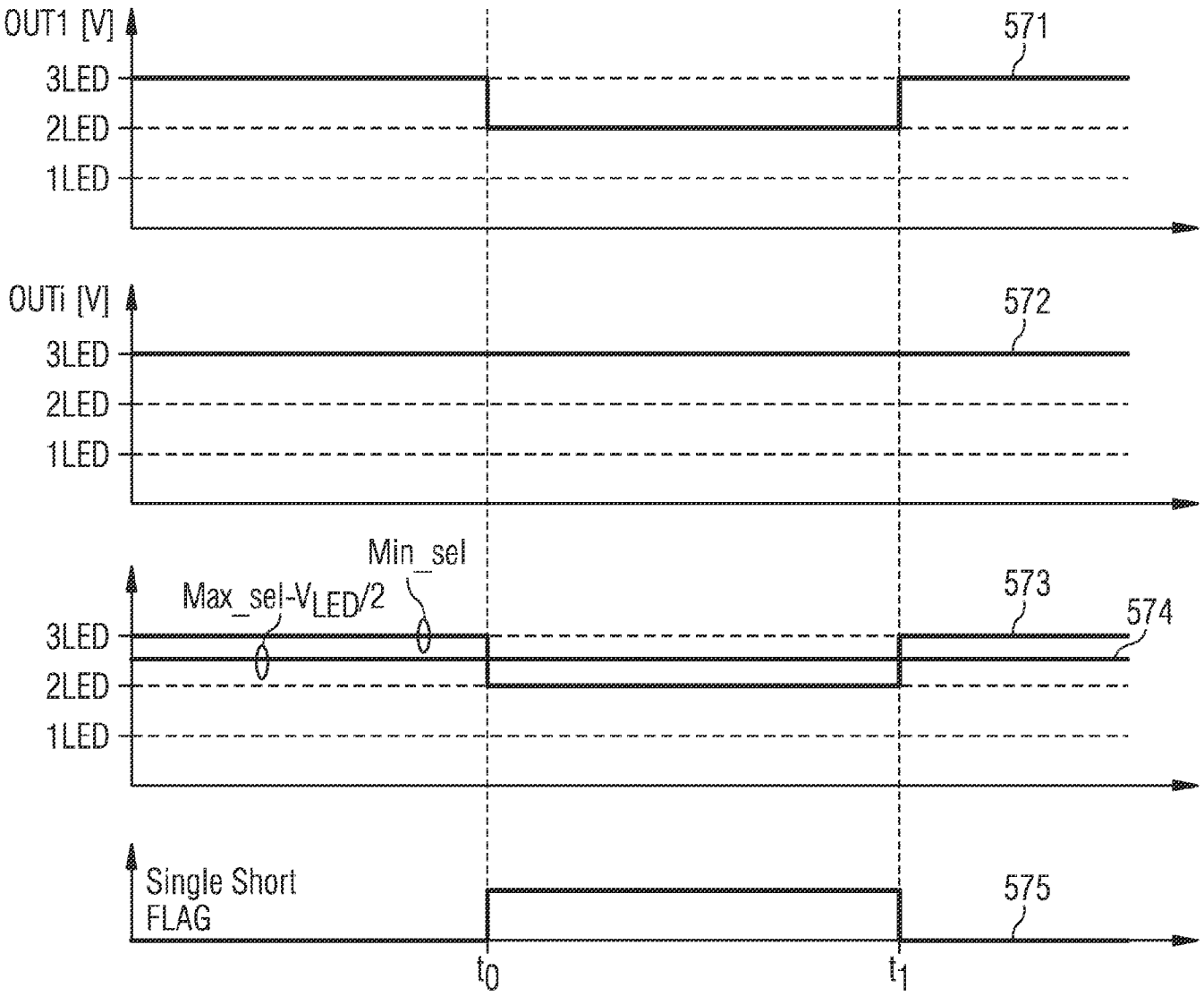
FIGS. 5A-5D are timing diagrams illustrating example waveforms of examples of waveforms of V1-VM, Vcomp, Vmaxselout and Vminselout of the circuit of FIG. 3 in a situation in which there is a single short in one of the LED chains from time t0 to time t1.

FIGS. 5A-5D are timing diagrams illustrating example waveforms of examples of waveforms of V1-VM, Vcomp, Vmaxselout and Vminselout of circuit 300 of FIG. 3 in a situation in which there is a single short in one of the LED chains 311-313 from time t0 to time t1. FIG. 5A illustrates a timing diagram of waveform 571 of whichever LED chain 311-313 has a single short from time t0 to time t1 (that is, one of the voltages V1-VM corresponding to whichever corresponds to the LED chain having the short). As shown, waveform 571 has a voltage corresponding to 2 LEDs during time t0 to time t1, when there is a short in one of the LEDs of the chain, and a voltage corresponding to 3 LEDs at other times.

FIG. 5B illustrates a timing diagram of an example of waveform 572 of each of the LED chains 311-313 which do not have a short. That is, each waveform 572 shows each series voltage V1-VM other than the one illustrated in FIG. 5A. As shown, waveform 572 has a voltage corresponding to 3 LEDs.

FIG. 5C illustrates a timing diagram of examples of waveforms 573 and 574 of voltages Vmaxselout and Vminselout, respectively. As discussed above with regard to FIG. 3, voltage Vmaxselout is equal to the maximum from among V1 through V3, less VLED/2, and voltage Vminselout is equal to the minimum from among V1 through V3. As shown, waveform 573 is equal to the voltage of 2.5 LEDs. Waveform 574 is equal to 2 LEDs from time t0 to time t1, and equal to 3 LEDs at other times.

FIG. 5D illustrates a timing diagram of an example of waveform 575 of voltage Vcomp. As shown, until time t0, waveform 575 corresponds to a logical low level, because, as shown in FIG. 5C, waveform 574 (corresponding to Vmaxselout) is less than waveform 573 (corresponding to Vminselout). Before time t0, waveform 575 is at a logical low level, indicating that no short is detected. At about time t0, the waveform 573 drops below the waveform 574, and therefore waveform 575 changes from a logical low to a logical high, indicating that a short is detected. In this case, a single short is detected in one of the chains.

At about time t1, the waveform 573 rises above waveform 574, and therefore waveform 575 changes from the logical high level back to the logical low level, indicating that the short condition is no longer present.

Figure 6:
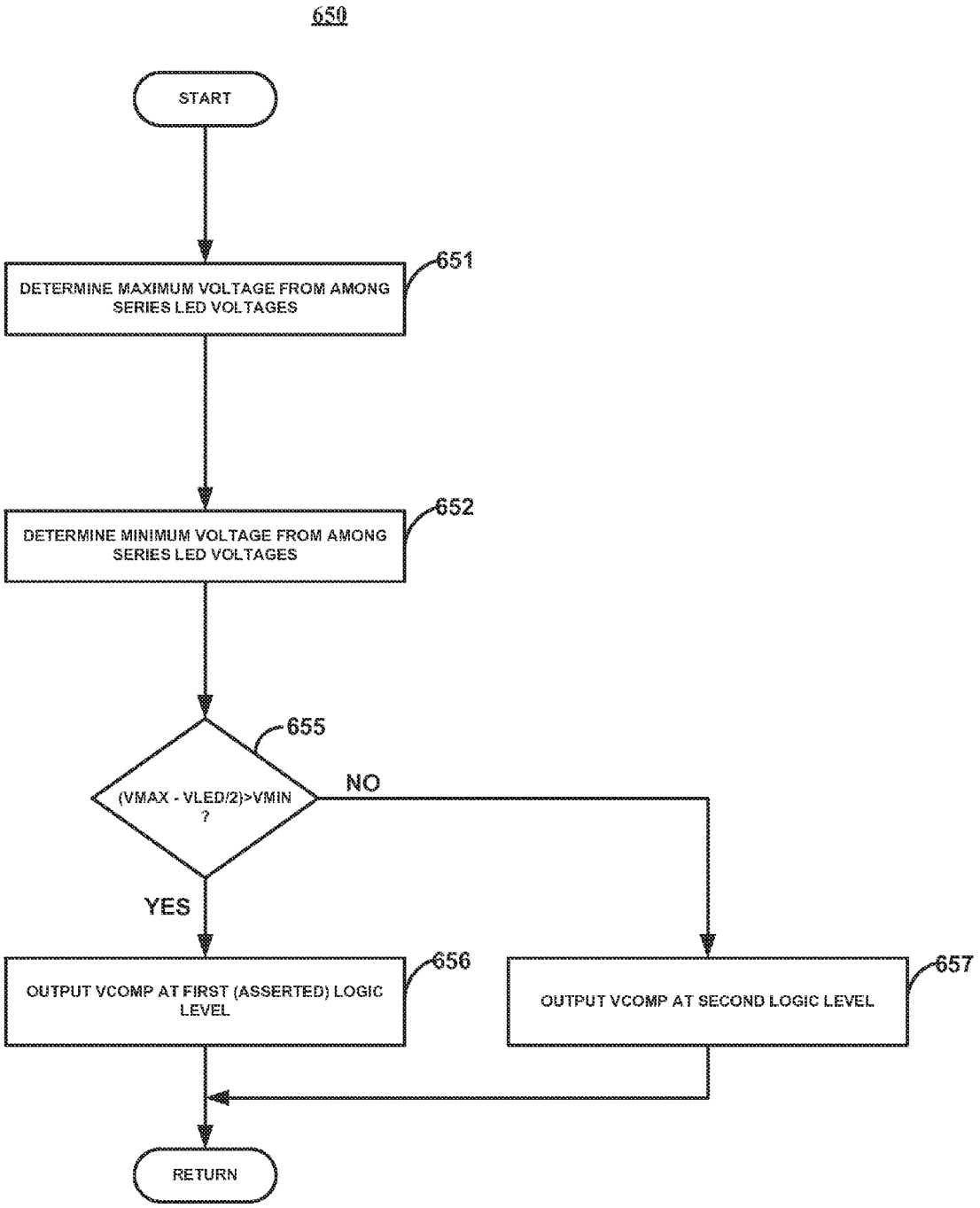
FIG. 6 is a flow diagram illustrating an example of the process of FIG. 2 for an example of the circuit of FIG. 4.

FIG. 6 is a flow diagram illustrating an example of a process (650) for failure detection for series LED chains. The following is one example of process 650 as performed by circuit 400. However, the disclosure is not so limited, and other suitable devices and/or circuits may implement circuit 400 in other examples within the scope and spirit of the disclosure.

After a start block, maximum selector circuit 420 determines a maximum voltage (Vmax) from among series LED voltage V1 through V3 (651). Then, minimum selector circuit 430 determines the minimum voltage (Vmin) from among series LED voltages V1 through V3 (652).

Next, comparison circuit 440 compares Vmax with Vmin to make a determination as to whether (Vmax−VLED/2) is greater than Vmin (655). If so, comparison circuit 440 output Vcomp at a first logic level (i.e., the asserted logic level, where Vcomp may be asserted high in some examples and asserted low in other examples) (656). The process then proceeds to a return block, where other processing is resumed.

If, however at decision block 655 comparison circuit 440 determines that Vmin is greater than (Vmax−VLED/2), comparison circuit 440 outputs Vcomp at a second logic level (657). The process then moves to a return block, where other processing is resumed.

Various examples have been described. Many details of techniques of this disclosure have been described in the context of a device that includes a multi-channel single LED. However, the technique may also be applied with respect to other types of semiconductor light sources, or in other situations or devices that define a plurality of series load voltages. These and other examples are within the scope of the following claims.

What is claimed is:

1. A method, comprising:

determining, by a maximum selector circuit having a plurality of inputs and an output, a maximum voltage from among a plurality of series load voltages, wherein each series load voltage of the plurality of series load voltages is a voltage defined by a corresponding series of N loads of a plurality of series of N loads, wherein N is an integer greater than one, the maximum selector circuit is arranged to receive each series load voltage of a plurality of series load voltages at a corresponding input of the plurality of inputs, and the maximum selector circuit includes a bias current source having an output that is coupled to the output of the maximum selector circuit, and further includes, for each input of the plurality of inputs of the maximum selector circuit, a corresponding diode having an anode that is coupled to the corresponding input of the maximum selector circuit and a cathode that is coupled to the output of the maximum selector circuit;

determining, by a minimum selector circuit having a plurality of inputs and an output, a minimum voltage from among the plurality of series load voltages, wherein the minimum selector circuit is arranged to receive each series load voltage of the plurality of series load voltages at a corresponding input of the plurality of inputs of the minimum selector circuit;

comparing, by a comparison circuit having an output, a first input that is coupled to the output of the maximum selector circuit, and a second input that is coupled to the output of the minimum selector circuit, the maximum voltage from among the plurality of series voltages with the minimum voltage from among the plurality of series load voltages to make a determination as to whether the maximum voltage from among the plurality of series load voltages exceeds the minimum voltage from among the plurality of series voltages by the threshold voltage; and outputting an indication based on a result of the determination.

2. The method of claim 1, wherein each load of each series of N loads of the plurality of series of N loads is a diode.

3. The method of claim 1, wherein each load of each series of N loads of the plurality of series of N loads has an expected voltage drop, and wherein the threshold voltage is substantially equal to half of the expected voltage drop.

4. The method of claim 1, the threshold voltage is a substantially fixed, constant voltage.

5. The method of claim 1, further comprising adjusting the threshold voltage based on a user input.

6. The method of claim 1, wherein the determination is substantially independent of temperature.

7. The method of claim 1, wherein outputting the indication based on the result of the determination comprises outputting a status signal based on the result of the determination, wherein:

in response to determining that the maximum voltage from among the plurality of series load voltages exceeds the minimum voltage from among the plurality of series load voltages by the threshold voltage, the status signal comprises a first logic level; and in response to determining that the maximum voltage from among the plurality of series load voltages does not exceed the minimum voltage from among the plurality of series load voltages by the threshold voltage, the status signal comprises a second logic level.

8. The method of claim 1, wherein each load of each series of N loads of the plurality of series of N loads is a light-emitting diode (LED).

9. The method of claim 8, wherein each of the LEDs has an expected forward voltage drop, and wherein the threshold voltage is substantially equal to half of the expected forward voltage drop.

10. A method, comprising:

determining, by a maximum selector circuit having a plurality of inputs and an output, a maximum voltage from among a plurality of series load voltages, wherein each series load voltage of the plurality of series load voltages is a voltage defined by a corresponding series of N loads of a plurality of series of N loads, wherein N is an integer greater than one, the maximum selector circuit is arranged to receive each series load voltage of a plurality of series load voltages at a corresponding input of the plurality of inputs, and the maximum selector circuit includes a bias current source having an output that is coupled to the output of the maximum selector circuit, and further includes, for each input of the plurality of inputs of the maximum selector circuit, a corresponding diode having an anode that is coupled to the corresponding input of the maximum selector circuit and a cathode that is coupled to the output of the maximum selector circuit;

determining, by a minimum selector circuit having a plurality of inputs and an output, a minimum voltage from among the plurality of series load voltages, wherein the minimum selector circuit is arranged to receive each series load voltage of the plurality of series load voltages at a corresponding input of the plurality of inputs of the minimum selector circuit;

comparing, by a comparison circuit having an output, a first input that is coupled to the output of the maximum selector circuit, and a second input that is coupled to the output of the minimum selector circuit, the maximum voltage from among the plurality of series voltages with the minimum voltage from among the plurality of series load voltages to make a determination as to whether the maximum voltage from among the plurality of series load voltages exceeds the minimum voltage from among the plurality of series voltages by a threshold voltage, wherein each load of each series of N loads of the plurality of series of N loads is a light-emitting diode (LED);

outputting an indication based on a result of the determination; and de-activating a module that includes the plurality of series of N loads when a status signal is asserted.

11. A circuit, comprising:

a maximum selector circuit having a plurality of inputs and an output, wherein the maximum selector circuit is arranged to receive each series load voltage of a plurality of series load voltages at a corresponding input of the plurality of inputs, and to provide a maximum voltage from among the plurality of series load voltages at the output of the maximum selector circuit, wherein each series load voltage of the plurality of series load voltages is a voltage defined by a corresponding series of N loads of a plurality of series of N loads, wherein N is an integer greater than one, wherein the maximum selector circuit includes, for each input of the plurality of inputs of the maximum selector circuit, a corresponding diode having an anode that is coupled to the corresponding input of the maximum selector circuit and a cathode that is coupled to the output of the maximum selector circuit;

a minimum selector circuit having a plurality of inputs and an output, wherein the minimum selector circuit is arranged to receive each series load voltage of the plurality of series load voltages at a corresponding input of the plurality of inputs of the minimum selector circuit, and to provide a minimum voltage from among the plurality of series load voltages at the output of the minimum selector circuit, wherein the minimum selector circuit includes, for each input of the plurality of inputs of the minimum selector circuit, a corresponding diode having a cathode that is coupled to the corresponding input of the minimum selector circuit and an anode that is coupled to the output of the minimum selector circuit; and a comparison circuit having an output, a first input that is coupled to the output of the maximum selector circuit, and a second input that is coupled to the output of the minimum selector circuit, wherein the comparison circuit is arranged to compare the maximum voltage from among the plurality of series load voltages with the minimum voltage from among the plurality of series load voltages to make a determination as to whether the maximum voltage from among the plurality of series load voltages exceeds the minimum voltage from among the plurality of series load voltages by a threshold voltage; and to output, at the output of the comparison circuit, an indication based on a result of the determination.

12. The circuit of claim 11, wherein the comparison circuit includes a comparator.

13. The circuit of claim 11, wherein the comparison circuit includes a comparator, and further includes a transistor that is configured as a voltage follower.

14. The circuit of claim 11, wherein a portion of the maximum selector circuit is a portion of the minimum selector circuit.

15. The circuit of claim 11, wherein each load of each series of N loads of the plurality of series of N loads is a light-emitting diode (LED), each of the LEDs has an expected forward voltage drop, and wherein a value of the threshold voltage is selected such that the threshold voltage is substantially equal to half of the expected forward voltage.

16. The circuit of claim 11, wherein the circuit is an integrated circuit having a plurality of pins, and wherein the integrated circuit requires no more than N pins to perform the comparison of the comparison circuit.

17. The circuit of claim 11, wherein a value of the threshold voltage is selected in response to a user input.

18. A circuit, comprising:

a maximum selector circuit having a plurality of inputs and an output, wherein the maximum selector circuit is arranged to receive each series load voltage of a plurality of series load voltages at a corresponding input of the plurality of inputs, and to provide a maximum voltage from among the plurality of series load voltages at the output of the maximum selector circuit, wherein each series load voltage of the plurality of series load voltages is a voltage defined by a corresponding series of N loads of a plurality of series of N loads, wherein N is an integer greater than one, and wherein the maximum selector circuit includes a bias current source having an output that is coupled to the output of the maximum selector circuit, and further includes, for each input of the plurality of inputs of the maximum selector circuit, a corresponding diode having an anode that is coupled to the corresponding input of the maximum selector circuit and a cathode that is coupled to the output of the maximum selector circuit;

a minimum selector circuit having a plurality of inputs and an output, wherein the minimum selector circuit is arranged to receive each series load voltage of the plurality of series load voltages at a corresponding input of the plurality of inputs of the minimum selector circuit, and to provide a minimum voltage from among the plurality of series load voltages at the output of the minimum selector circuit; and a comparison circuit having an output, a first input that is coupled to the output of the maximum selector circuit, and a second input that is coupled to the output of the minimum selector circuit, wherein the comparison circuit is arranged to compare the maximum voltage from among the plurality of series load voltages with the minimum voltage from among the plurality of series load voltages to make a determination as to whether the maximum voltage from among the plurality of series load voltages exceeds the minimum voltage from among the plurality of series load voltages by a threshold voltage; and to output, at the output of the comparison circuit, an indication based on a result of the determination.

19. A circuit, comprising:

a maximum selector circuit having a plurality of inputs and an output, wherein the maximum selector circuit is arranged to receive each series load voltage of a plurality of series load voltages at a corresponding input of the plurality of inputs, and to provide a maximum voltage from among the plurality of series load voltages at the output of the maximum selector circuit, wherein each series load voltage of the plurality of series load voltages is a voltage defined by a corresponding series of N loads of a plurality of series of N loads, wherein N is an integer greater than one;

a minimum selector circuit having a plurality of inputs and an output, wherein the minimum selector circuit is arranged to receive each series load voltage of the plurality of series load voltages at a corresponding input of the plurality of inputs of the minimum selector circuit, and to provide a minimum voltage from among the plurality of series load voltages at the output of the minimum selector circuit, and wherein the minimum selector circuit includes a bias current source having an output that is coupled to the output of the minimum selector circuit, and further includes, for each input of the plurality of inputs of the minimum selector circuit, a corresponding diode having a cathode that is coupled to the corresponding input of the minimum selector circuit and an anode that is coupled to the output of the minimum selector circuit; and a comparison circuit having an output, a first input that is coupled to the output of the maximum selector circuit, and a second input that is coupled to the output of the minimum selector circuit, wherein the comparison circuit is arranged to compare the maximum voltage from among the plurality of series load voltages with the minimum voltage from among the plurality of series load voltages to make a determination as to whether the maximum voltage from among the plurality of series load voltages exceeds the minimum voltage from among the plurality of series load voltages by a threshold voltage; and to output, at the output of the comparison circuit, an indication based on a result of the determination.

* * * * *